US009738481B2

(12) United States Patent
Lee et al.

(10) Patent No.: US 9,738,481 B2
(45) Date of Patent: Aug. 22, 2017

(54) PRINT MEDIUM FINISHING UNIT AND IMAGE FORMING APPARATUS HAVING THE SAME

(71) Applicant: Samsung Electronics Co., Ltd., Suwon-si (KR)

(72) Inventors: Ho Il Lee, Yongin-si (KR); Joon Sik An, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 220 days.

(21) Appl. No.: 14/728,102

(22) Filed: Jun. 2, 2015

(65) Prior Publication Data

US 2015/0368061 A1 Dec. 24, 2015

(30) Foreign Application Priority Data

Jun. 23, 2014 (KR) ..... 10-2014-0076483

(51) Int. Cl.

| | |
|---|---|
| ***B65H 37/04*** | (2006.01) |
| ***B65H 31/26*** | (2006.01) |
| ***B65H 31/02*** | (2006.01) |
| ***G03G 15/00*** | (2006.01) |

(52) U.S. Cl.

CPC ..... *B65H 37/04* (2013.01); *B65H 31/02* (2013.01); *B65H 31/26* (2013.01); *G03G 15/6582* (2013.01); *B65H 2301/4213* (2013.01); *B65H 2402/545* (2013.01); *B65H 2405/1134* (2013.01); *B65H 2408/122* (2013.01); *B65H 2801/27* (2013.01)

(58) Field of Classification Search

CPC . G03G 2215/00827; B41L 43/12; B42C 1/12; B65H 37/04; B65H 2404/1222; B65H 31/00; B65H 9/04; B65H 9/06; B65H 2301/36

USPC ..... 270/58.08, 58.11, 58.12, 58.16, 58.17, 270/58.27

See application file for complete search history.

(56) References Cited

U.S. PATENT DOCUMENTS

| | | | | |
|---|---|---|---|---|
| 5,290,020 A * | 3/1994 | Matsui | B42B 4/00 | 227/111 |
| 6,264,189 B1 * | 7/2001 | Kawata | B65H 29/51 | 271/176 |
| 6,607,188 B2 * | 8/2003 | Sato | B27F 7/17 | 227/111 |
| 7,568,688 B2 * | 8/2009 | Nomura | B65H 29/58 | 270/58.08 |
| 7,699,302 B2 * | 4/2010 | Ichikawa | B42C 1/12 | 270/32 |
| 8,702,087 B2 * | 4/2014 | Furuhashi | B65H 31/38 | 270/58.12 |

(Continued)

*Primary Examiner* — Leslie A Nicholson, III

(74) *Attorney, Agent, or Firm* — Staas & Halsey LLP

(57) ABSTRACT

A print medium finishing unit may include a load part in which print media is loaded, a stapler stapling the print media loaded in the load part while moving along one side end of the print media, and at least one arrangement member supporting one side end of the print media, wherein the arrangement member protrudes toward a moving path of the stapler to move between an arrangement position supporting one side end of the plurality of print media and an escape position escaping from a moving path of the stapler by receiving a force through the moving stapler. Therefore, a moving path of the stapler has a simple structure.

15 Claims, 10 Drawing Sheets

(56) References Cited

U.S. PATENT DOCUMENTS

| | | | |
|---|---|---|---|
| 2012/0319344 | A1 | 12/2012 | Nakamichi |
| 2013/0285312 | A1 | 10/2013 | Tokuma et al. |
| 2013/0285313 | A1 | 10/2013 | Iwata |

* cited by examiner

PRINT MEDIUM FINISHING UNIT AND IMAGE FORMING APPARATUS HAVING THE SAME

CROSS-REFERENCE TO RELATED APPLICATIONS

This application claims the priority benefit of the Korean Patent Application No. 10-2014-0076483, filed on Jun. 23, 2014, in the Korean Intellectual Property Office, the disclosure of which is incorporated herein by reference.

BACKGROUND

1. Field

Embodiments of the present disclosure relate to a print medium finishing unit configured to post-processing by receiving print medium or print media in which an image forming is completed, and an image forming apparatus having the same.

2. Description of the Related Art

In general, an image forming apparatus is an apparatus configured to form an image, and includes a printer, a copy machine, a facsimile, and a multi-function apparatus implemented by integrating the functionalities of the printer, the copy machine and the facsimile.

Among the imaging forming apparatus, there is an imaging forming apparatus provided with a print medium finishing unit configured to post-processing by receiving print medium in which an image forming is completed.

A representative role of the print medium finishing unit is stapling print media using a stapler included inside after receiving print media in which an image forming is completed, and then arranging the print media.

SUMMARY

In an aspect of one or more embodiments, there is provided to a print medium finishing unit capable of simplifying a moving path of a stapler and an image forming apparatus having the same.

In accordance with an aspect of one or more embodiments, there is provided a print medium finishing unit which includes a load part in which print media is loaded, a stapler which staples print media loaded in the load part while moving along one side end of print media, and an arrangement member which supports one side end of the print media, wherein the arrangement member protrudes toward a moving path of the stapler to move between an arrangement position supporting one side end of the print media and an escape position escaping from a moving path of the stapler by receiving a force through the moving stapler.

The arrangement member may be rotatably installed to move between the arrangement position and the escape position while rotating.

The arrangement member may further include an elastic member to allow the arrangement member to return the arrangement position by supporting the arrangement member.

The moving path may include a parallel path in parallel to one side end of the print media, and the arrangement member may protrude toward the parallel path of the stapler.

The moving path may include a first inclined path extended to be inclined from one side of the parallel path to correspond to one side corner of the print media, and a second inclined path extended to be inclined from the other side of the parallel path to correspond to the other side corner of the print media.

The print medium finishing unit may further include a guide member in which the stapler is movably installed, the guide member may include guide slots forming the moving path, and the stapler may include a guide protrusion movably installed on the guide slots.

The guide slots may include a parallel part extended in parallel to one side end of the print medium to form the parallel path, a first inclined part extended to be inclined from one side of the parallel part to form the first inclined path, and a second inclined part extended to be inclined from the other side of the parallel part to form the second inclined path.

The arrangement member may include a pair of arrangement members spaced apart from to each other in a width direction of the plurality of print media.

The print medium finishing unit may further include a tray in which stapled print media is loaded, and an ejector module which transmits the stapled print media to the tray.

In accordance with an aspect of one or more embodiments, there is provided an image forming apparatus which includes an image forming unit which forms images on print media, and a print medium finishing unit which receives print media having images, and post processing the print media, wherein the print medium finishing unit includes a load part in which print media is loaded, a stapler which staples print media loaded in the load part while moving along one side end of the print media, and an arrangement member supporting one side end of the print media, wherein the arrangement member protrudes toward a moving path of the stapler to rotate between an arrangement position supporting one side end of the print media and an escape position escaping from the moving path of the stapler by receiving a force through the moving stapler.

The image forming unit may include a paper discharge part which discharges the print media having the formed images, wherein the image forming unit may be connected to the paper discharge part.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
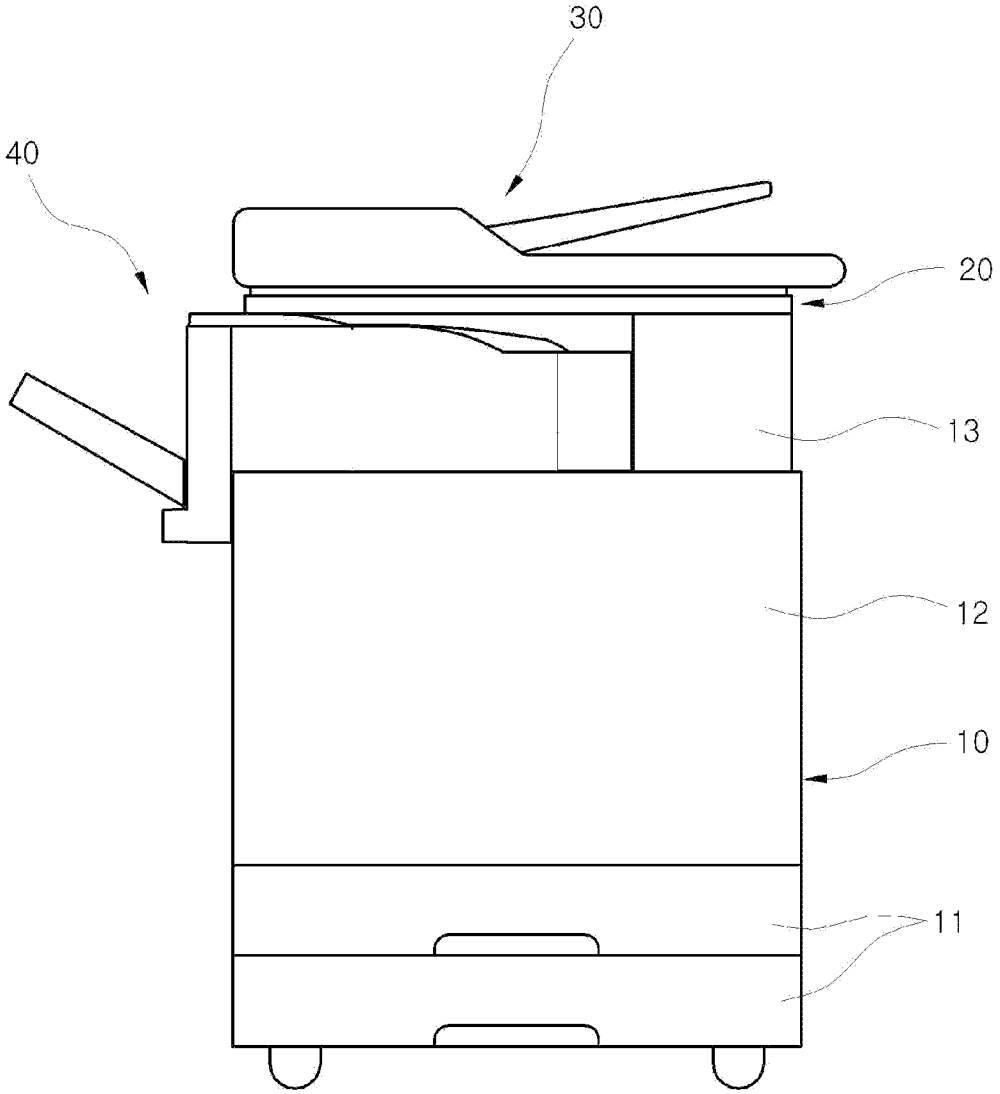
FIG. 1 is a view schematically illustrating an image forming apparatus provided with a print medium finishing unit in accordance with an embodiment.

Reference will now be made in detail to embodiments, examples of which are illustrated in the accompanying drawings, wherein like reference numerals refer to like elements throughout.

As illustrated in FIG. 1, an image forming apparatus includes an image forming unit 10 forming an image on a printing medium P, an image read out unit 20 provided in an upper portion to read out a document, a document supply unit 30 provided in an upper portion of the image read out unit 20 to automatically supply a document which is read out in the image read out unit 20, and a print medium finishing unit 40 receiving print medium P in which an image forming is completed from the image forming unit 10 and post processing the print medium P.

The image forming unit 10 includes a paper supply part 11 provided on a lower portion of the image forming unit 10 to supply print medium P in which an image is to be formed, an image forming part 12 provided on an upper portion of the paper supply part 11 to form an image on the print medium P received from the paper supply part 11, and a supply discharge part 13 provided on an upper portion of one side of the image forming part 12 to discharge the print medium P which is forming an image is completed.

The print medium finishing unit 40 is installed on the other side of the upper portion of the image forming unit 10, and receives the print medium P discharged from the paper discharge part 13 by being connected to the paper discharge part 13 of the image forming unit 10, thereby post processing the print medium P. In one or more embodiments, the print medium finishing unit 40 is detachably installed on the image forming unit 10 to be coupled to the image forming unit 10 so as to be selectively used only when the print medium P is needed to be post processed.

Figure 2:
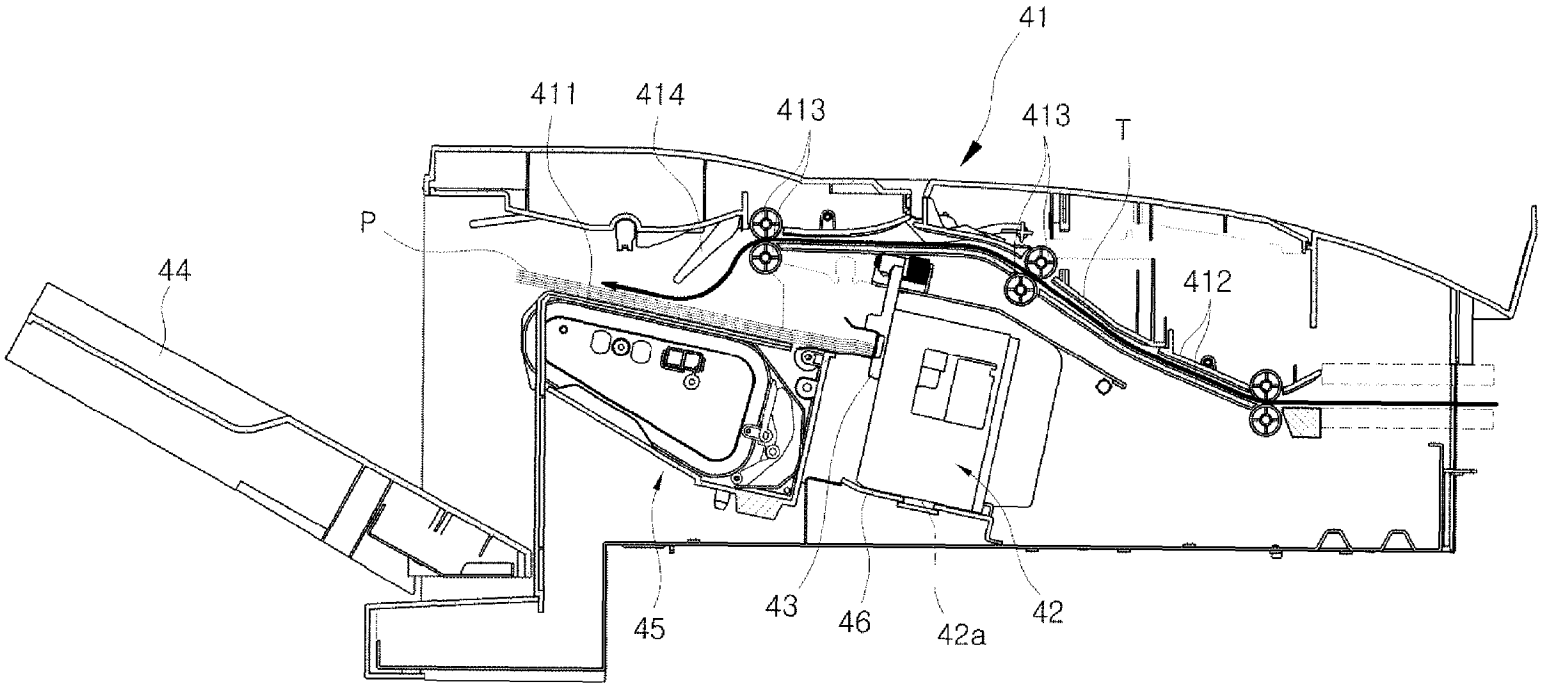
FIG. 2 is a cross-sectional view illustrating an inner configuration of a print medium finishing unit in accordance with an embodiment.
Figure 3:
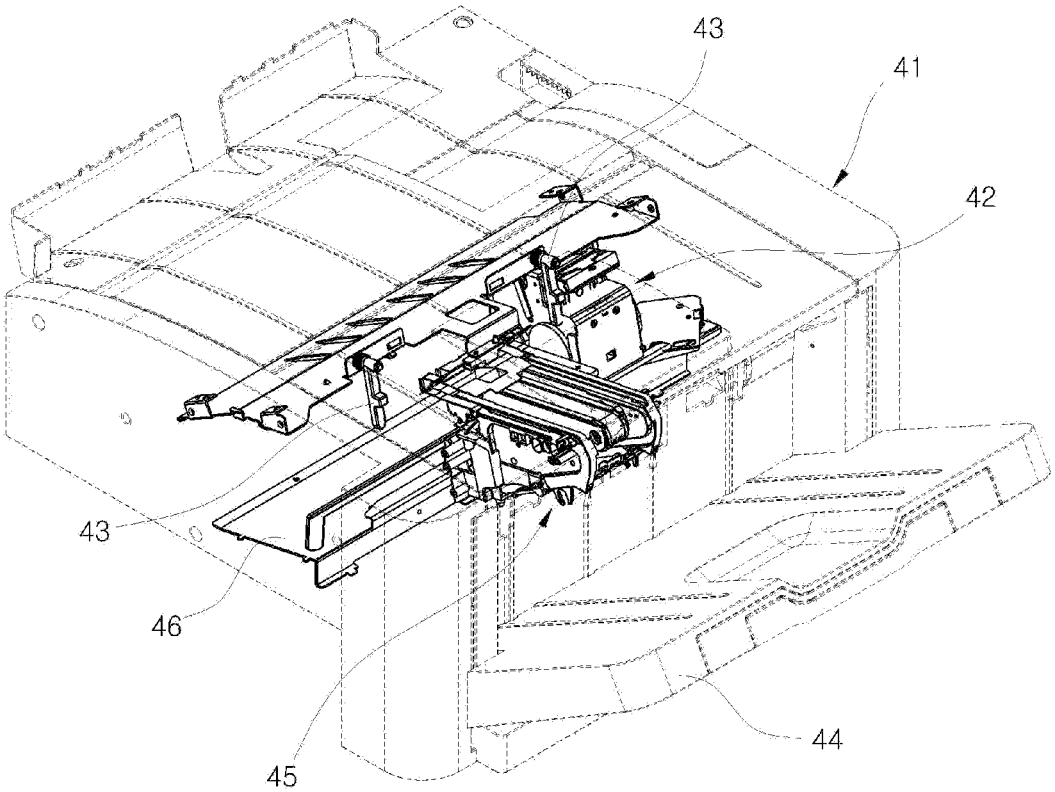
FIGS. 3 and 4 are perspective views illustrating an inner configuration of a print medium finishing unit in accordance with an embodiment.
Figure 4:
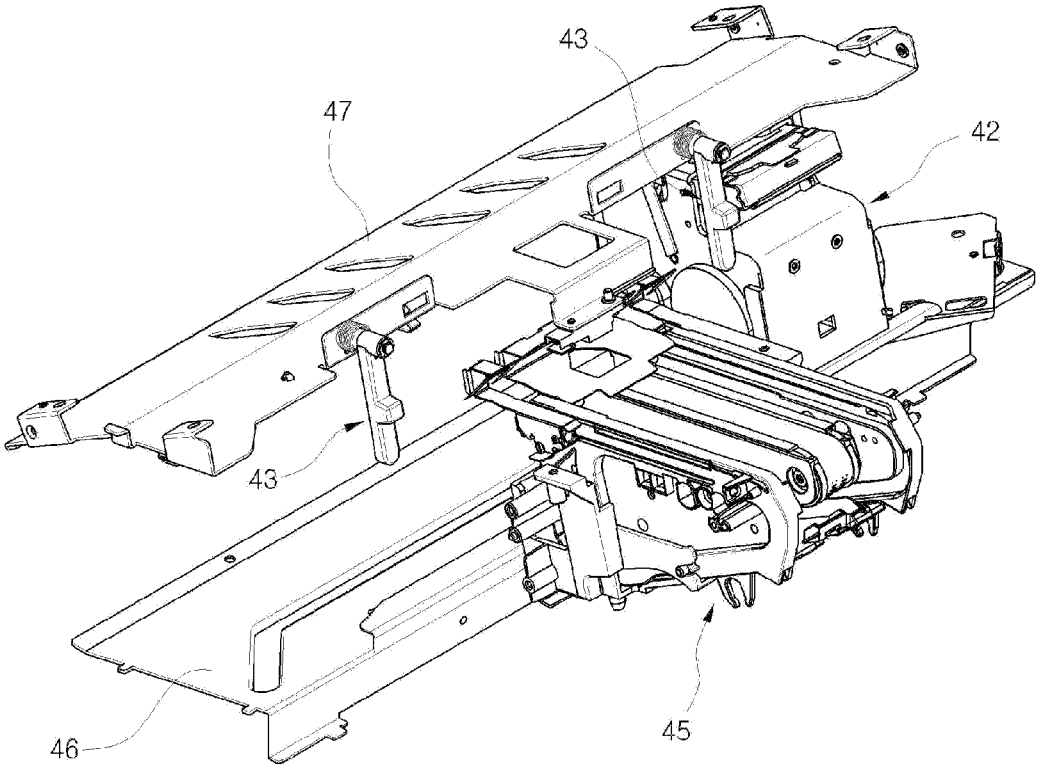

As illustrated in FIGS. 2 to 4, the print medium finishing unit 40 includes a body 41 forming an exterior thereof, a load part 411 provided inside the body 41 to load a plurality of print media P, which is to be delivered from the image forming unit 10, in order, a stapler 42 stapling the print medium P loaded in the load part 411, and an arrangement member 43 provided in a pair to support one side end of the print medium P loaded in the load part 411 so that the print medium is arranged.

In addition, a tray 44 is provided on end of the body 11 to load the print medium P in which stapling is completed, and an ejector module 45 is provided in the center of the load part 411 to eject the print medium P, in which stapling is completed, from the load part 111 to the tray 44. Although not illustrated in drawings, the print medium finishing unit 40 includes a driving device configured to move the stapler 42.

A plurality of guide members 412 forming a conveying path T to guide the print medium P delivered from the image forming unit 10 to the load part 411, and a plurality of conveying rollers 413 provided on the conveying path T to allow the print medium P to be moved along the conveying path T are provided inside the body 41.

The load part 411 is provided on one side of the inside of the body 41 to allow the print medium P to be loaded on an upper surface thereof. The upper surface of the load part 411 is formed to be upwardly inclined so that one end of the print medium P loaded in the load part 411 is supported by the arrangement member 43, which will be described later.

A paddle 414 is disposed on an upper side of the load part 411 so that the print medium P loaded in the load part 411 is moved and the one side end of the print medium P is supported by the paddle 414.

Figure 5:
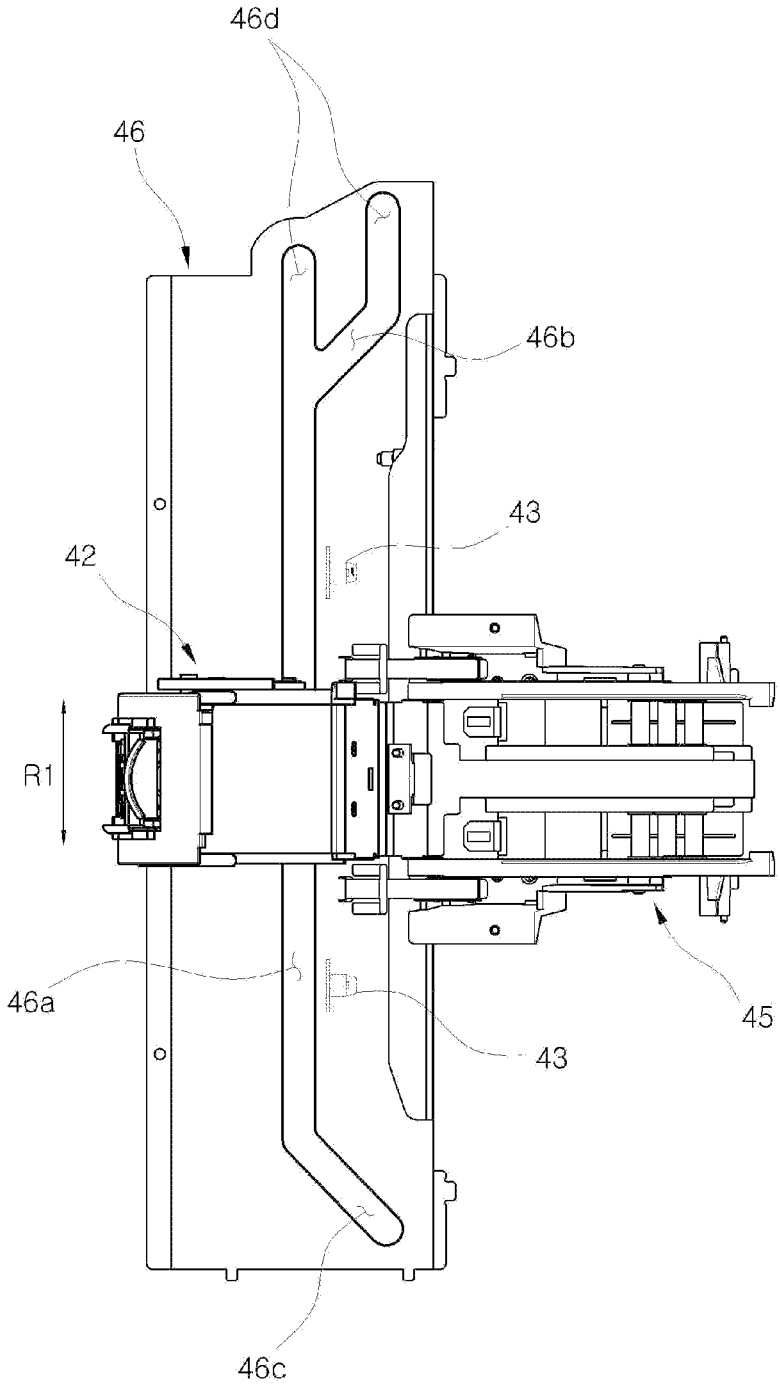
FIGS. 5 to 7 are a plane view illustrating a moving path of a stapler in a print medium finishing unit in accordance with an embodiment.
Figure 6:
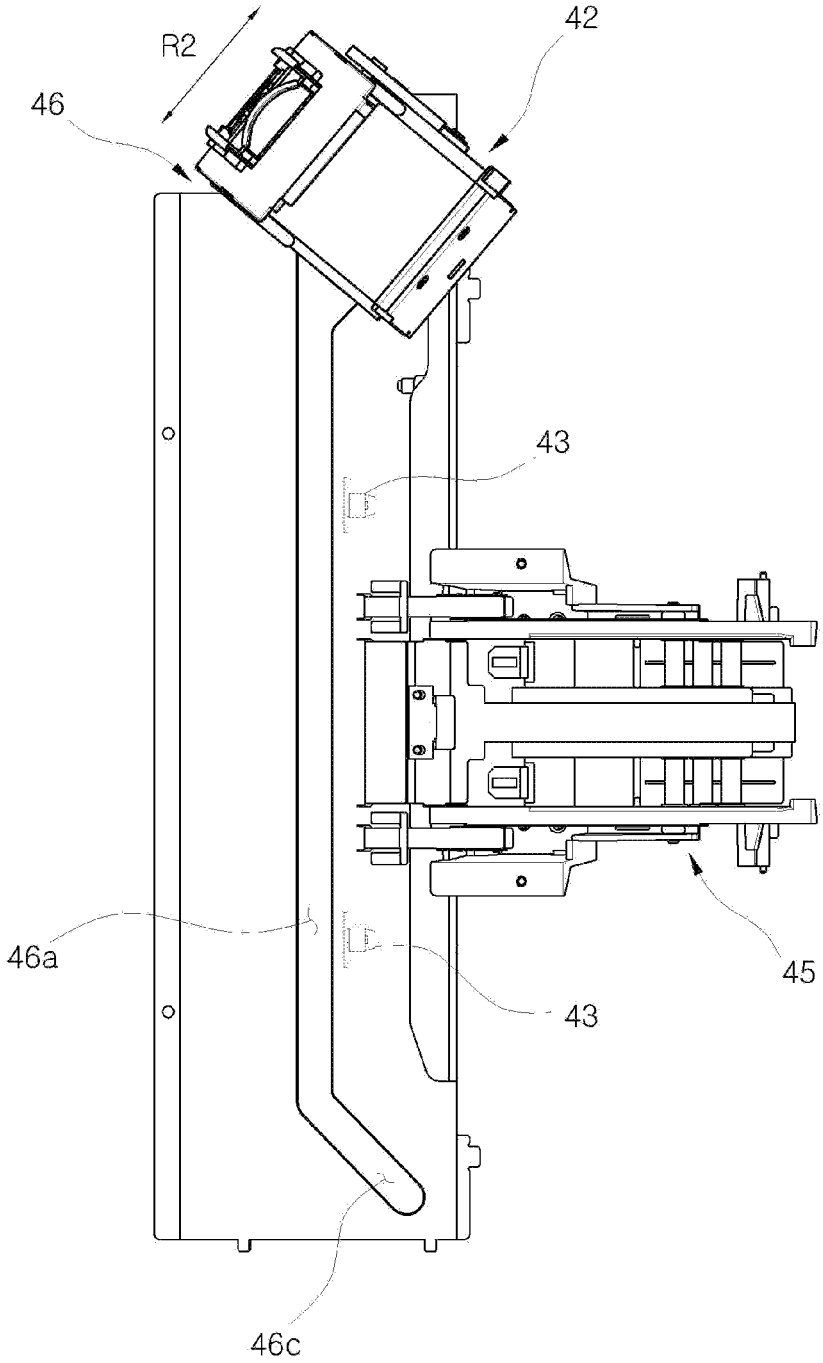
Figure 7:
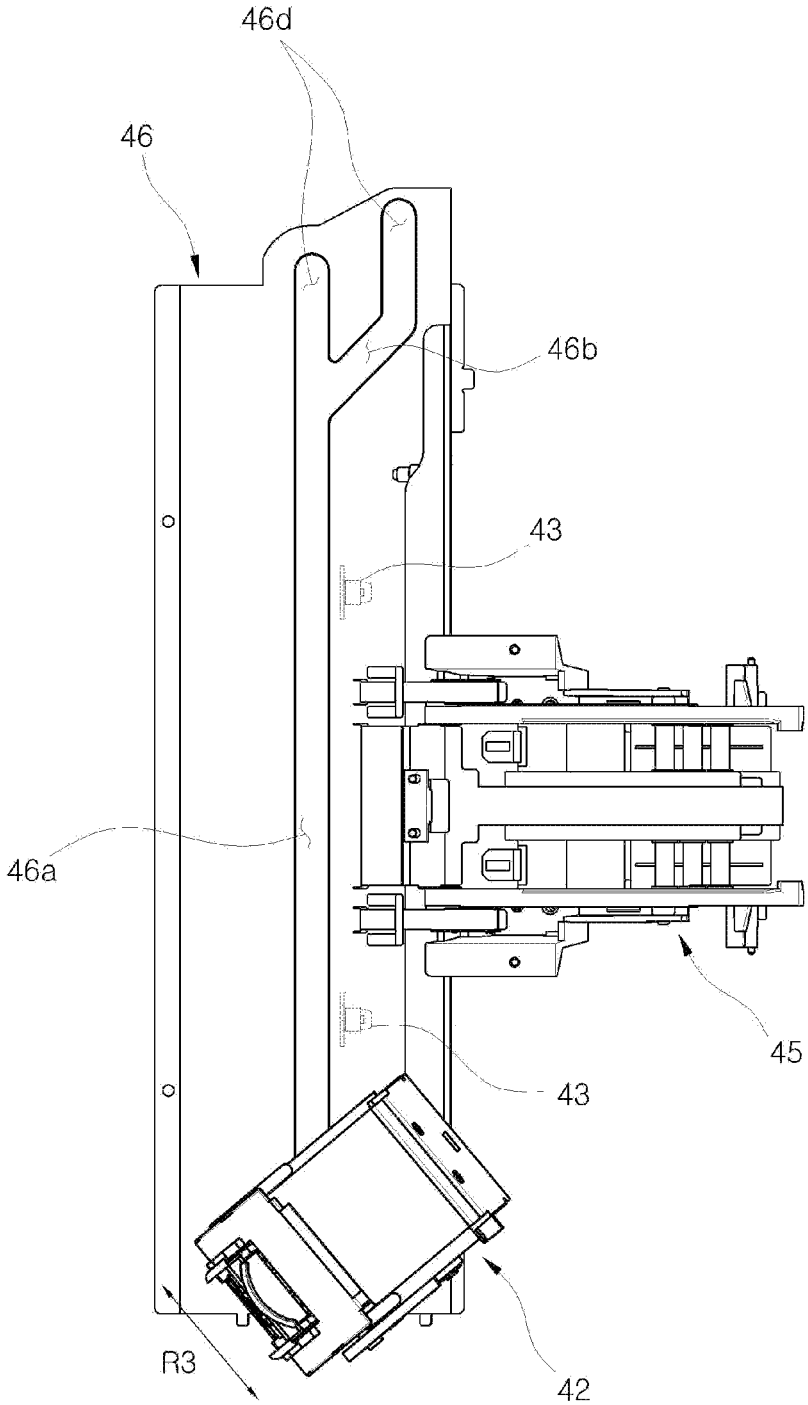

As illustrated in FIG. 5, the stapler 42 is movably installed inside the body 41 to staple various portions of the print medium P loaded in the load part 411. A moving path R1, R2, and R3 of the stapler 42 includes a parallel path R1 in which the stapler 42 is moved in parallel to the one side end of the print medium P, a first inclined path R2 in which the stapler 42 is moved to be inclined from the one side of the parallel path R1 to correspond to one side corner of the print medium P, as illustrated in FIG. 6, and a second inclined path R3 in which the stapler 42 is moved to be inclined from the other side of the parallel path R1 to correspond to the other side corner of the print medium P, as illustrated in FIG. 7. Therefore, the stapler 42 may be moved in parallel to the one end of the print medium P in the parallel path R1 while performing stapling. In addition, the stapler 42 may staple to be inclined on the side corner of the print medium P in the first inclined path R2, and may staple to be inclined on the other side corner of the print medium P in the second inclined path R3.

A guide plate 46 is disposed on the inside of the body 41 so that the stapler 42 is moved along the moving path R1, R2, and R3, as mentioned above.

Guide slots 46*a*-46*d* forming the moving path R1, R2, and R3 are provided in the guide plate 46. A pair of guide protrusion (42*a*) movably installed on the guide slots 46*a*-46*d* are provided in the stapler 42.

The guide slots 46*a*-46*d* includes a parallel part 46*a* extended in parallel to the one side end of the print medium P to allow the stapler 42 to be moved along the parallel path R1, a first inclined part 46*b* extended to be inclined from one side of the parallel part 46*a* to allow the stapler 42 to be moved along the first inclined path R2, and a second inclined part 46*c* extended to be inclined from the other side of the parallel part 46*a* to allow the stapler 42 to be moved along the second inclined path R3. In addition, a withdrawable part 46*d* is provided on one side of the guide slots 46*a*-46*d* to be extended from one side of the parallel part 46*a* and one side of the first inclined part 46*b* in parallel to each other so that a user inputs stapler chips by withdrawing the stapler 42.

Figure 9:
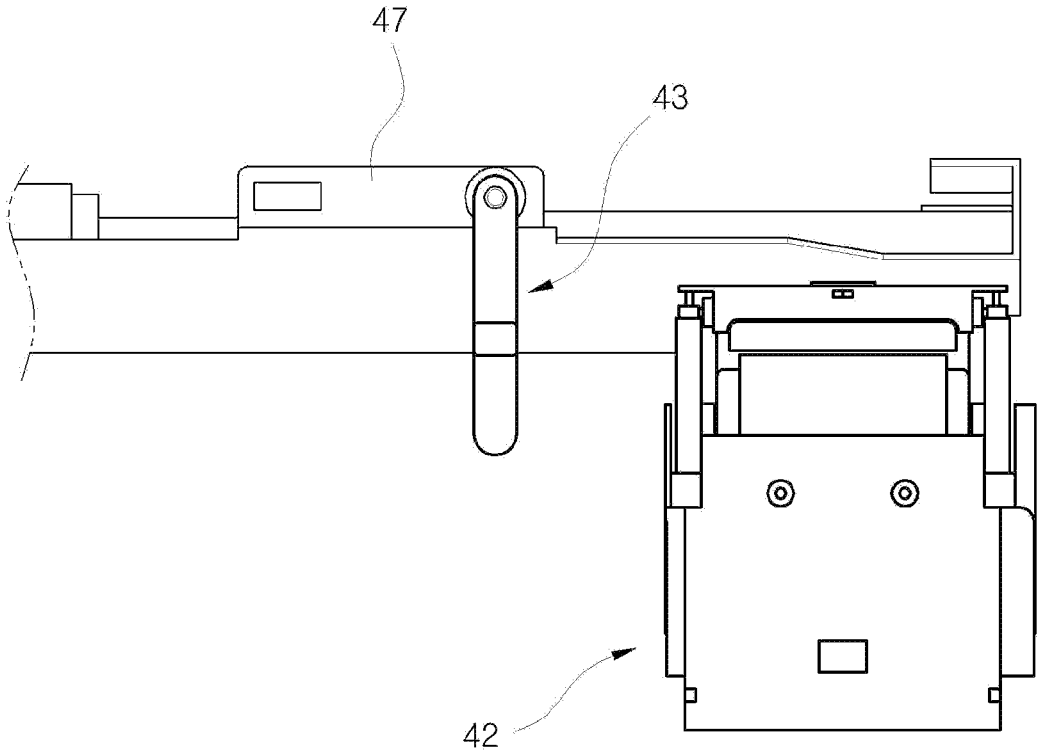
FIG. 9 is a view of illustrating when an arrangement member is placed in an arrangement position in a print medium finishing unit in accordance with an embodiment.
Figure 10:
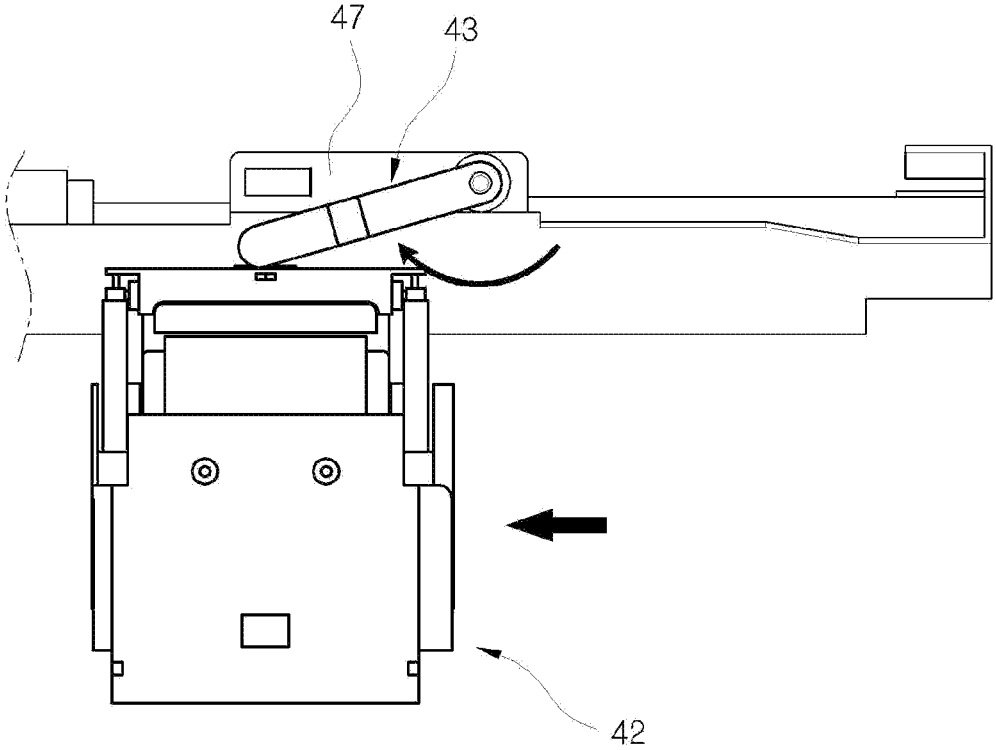
FIG. 10 is a view of illustrating when an arrangement member is placed in an escape position in a print medium finishing unit in accordance with an embodiment.

As illustrated in FIG. 9, the arrangement member 43 is protruded toward the moving path of the stapler 42 to be moved between an arrangement position supporting the one side end of the print medium P loaded in the load part 411 and as illustrated in FIG. 10, an escape position escaping from the moving path of the stapler 42 by receiving a force from the stapler 42 moving along the parallel part 46*a*.

In addition, the print medium finishing unit 40 includes an elastic member 49 elastically supporting the arrangement member 43 so that the stapler 42 passes through a position where the elastic member 43 is placed and returns to the arrangement position of the arrangement member 43.

Figure 8:
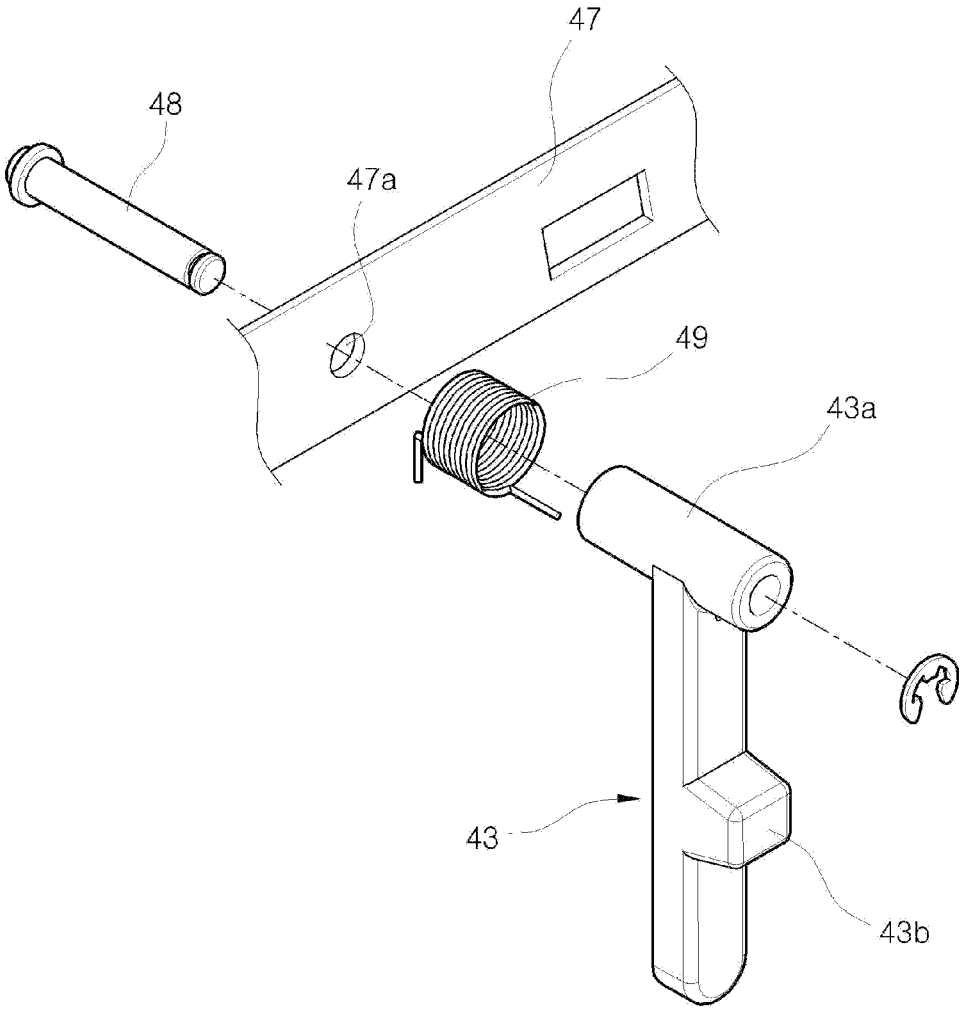
FIG. 8 is an exploded view illustrating an installation of an arrangement member in a print medium finishing unit in accordance with an embodiment.

In one or more embodiments, as illustrated in FIG. 8, the arrangement member 43 is rotatably installed in the support frame 46 fixed to the inside of the body 41 to be moved between the arrangement position and the escape position while being rotated. In addition, the arrangement member 43 is formed in a shape of a long bar in upward and downward and a pair of the arrangement member 43 are spaced apart from each other in the width direction of the print medium P so that two arrangement member 43 are arranged to simultaneously support two portion of the one side end of the print medium P.

The arrangement member 43 includes the hinge part 43*a* and a locking protrusion 43*b*. The hinge part 43*a* is provided on an upper end of the arrangement member 43 to be rotatably installed on a hinge hole 47*a* provided in the support frame 47 through a pin 48 and the locking protrusion 43*b* is provided on the center of the arrangement member 43 so that a height of the one side end of the print medium P loaded in the load part 411 is below a certain level.

The elastic member 49 is formed by torsion spring and installed on the hinge part 43*a* of the arrangement member 43 so that the arrangement member 43 returns to the arrangement position.

Hereinafter detailed description of operations of the print medium finishing unit will be described with reference to drawings.

In a state where the stapler 42 is placed on the both sides of the parallel part, or on the first inclined part 46*b* or the second inclined 46*c*, as illustrated in FIGS. 6 and 7, the two arrangement member 43 are maintained to be placed in the arrangement position by the elastic member 49, as illustrated in FIG. 9.

Therefore, in this state, as mentioned above, when the print medium P is delivered from the image forming unit 10, the print medium P is loaded in the load part 411 in order. At this time, the one side end of the print medium P is supported by the two arrangements 43 through the paddle 414 while the print medium P is loaded in the load part 411. Therefore, the print medium P is loaded while being arranged.

As mentioned above, the print medium P loaded in the load part 411 while being arranged, is stapled by the stapler 42 moved by driving force delivered from the driving device. The stapler 42 is moved along the guide slots 46*a*~46*d* by the driving force delivered from the driving device.

When the stapler 42 moves along the parallel part 46*a* of the guide slots 46*a*~46*d* and then reaches a position where the arrangement member 43 is installed, as illustrated in FIG. 5, a portion of the force generated in the driving device is delivered to the arrangement member 43 protruding on the moving path (the parallel path R1) of the stapler 42, and then the arrangement member 43 is rotated from the arrangement position to the escape position while the elastic member 49 is elastically deformed by the force.

When the stapler 42 moves and then passes through a position where the arrangement member 43 is installed, the force applied to the arrangement member 43 is released and then the arrangement member 43 is returned again from the escape position to the arrangement position to support again the one side end of the print medium P, as illustrated in FIG. 9, while the elastic member 49 elastically deformed is elastically restored.

As mentioned above, since the arrangement member 43 is rotated toward the escape position by receiving the force from the stapler 42 according to the movement of the stapler 42, the moving path of the stapler 42 may be simply configured by using the parallel path R1, the first inclined path R2, and the second inclined path R3, and the arrangement member 43 may be operated without an additional driving device.

The print medium finishing unit 40 having the configuration may allow the stapler 42 to staple at more various positions of the print medium P since the stapler 42 is capable of stopping at any position on the parallel part 46*a*.

As is apparent from the above description, according to an aspect of a print medium finishing unit and an image forming apparatus having the same, the arrangement member supporting one side end of the print medium moves to the escape position according to the movement of the stapler, thereby simplifying a moving path of the stapler.

In addition, since the arrangement member is operated by receiving a driving force from the moving stapler, there is no need to provide the driving device driving the arrangement member.

In addition, according to an aspect of a print medium finishing unit and an image forming apparatus having the same, the stapler may be allowed to be stopped at any position on the parallel path to staple at more various positions of the print medium.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A print medium finishing unit, comprising:

a load part in which print media is loaded;

a stapler which staples print media loaded in the load part while moving along one side end of the print media; and an arrangement member which supports one side end of the print media, wherein the arrangement member protrudes toward a moving path of the stapler to move between an arrangement position supporting one side end of the print media and an escape position escaping from the moving path of the stapler by receiving a force from the moving stapler, and wherein the arrangement member is rotatably installed in a moving direction of the stapler to move between the arrangement position and the escape position while rotating.

2. The print medium finishing unit of claim 1, wherein the arrangement member further comprises an elastic member to allow the arrangement member to return to the arrangement position by supporting the arrangement member.

3. The print medium finishing unit of claim 2, wherein the moving path comprises a parallel path in parallel to one side end of the print media, and the arrangement member protrudes toward the parallel path of the stapler.

4. The print medium finishing unit of claim 3, wherein the moving path comprises a first inclined path extended to be inclined from one side of the parallel path to correspond to one side corner of the print media, and a second inclined path extended to be inclined from the other side of the parallel path to correspond to the other side corner of the print media.

5. The print medium finishing unit of claim 4, further comprising:

a guide member in which the stapler is movably installed, wherein the guide member comprises guide slots forming the moving path, and the stapler comprises a guide protrusion movably installed on the guide slots.

6. The print medium finishing unit of claim 5, wherein the guide slots comprise a parallel part extended in parallel to one side end of the print medium to form the parallel path, a first inclined part extended to be inclined from one side of the parallel part to form the first inclined path, and a second inclined part extended to be inclined from the other side of the parallel part to form the second inclined path.

7. The print medium finishing unit of claim 1, wherein the arrangement member comprises a pair of arrangement members spaced apart from each other in a width direction of the plurality of print media.

8. The print medium finishing unit of claim 1, further comprising:

a tray in which stapled print media is loaded; and an ejector module which transmits the stapled print media to the tray.

9. An image forming apparatus comprising:

an image forming unit which forms images on print media; and a print medium finishing unit which receives print media having the images, and post processing the print media, wherein the print medium finishing unit comprises:

a load part in which print media is loaded;

a stapler which staples print media loaded in the load part while moving along one side end of the print media; and an arrangement member supporting one side end of the print media and rotatably installed in a moving direction of the stapler, wherein the arrangement member protrudes toward a moving path of the stapler to rotate between an arrangement position supporting one side end of the print media and an escape position escaping from the moving path of the stapler by receiving a force from the moving stapler.

10. The image forming apparatus of claim of 9, wherein the arrangement member further comprises an elastic member to allow the arrangement member to return to the arrangement position by supporting the arrangement member.

11. The image forming apparatus of claim of 9, wherein:

the moving path comprises a parallel path in parallel to one side end of the print media, a first inclined path extended to be inclined from one side of the parallel path to correspond to one side corner of the print media, and a second inclined path extended to be inclined from the other side of the parallel path to correspond to the other side corner of the print media, and the one arrangement member protrudes toward the parallel path of the stapler.

12. The image forming apparatus of claim of 11, further comprising:

a guide member in which the stapler is movably installed, wherein the guide member comprises guide slots forming the moving path, and the stapler comprises a guide protrusion movably installed on the guide slots.

13. The image forming apparatus of claim of 12, wherein the guide slots comprise a parallel part extended in parallel to one side end of the print medium to form the parallel path, a first inclined part extended to be inclined from one side of the parallel part to form the first inclined path, and a second inclined part extended to be inclined from the other side of the parallel part to form the second inclined path.

14. The image forming apparatus of claim of 9, further comprising:

a paper discharge part which discharges the print media having the formed images, wherein the image forming unit is connected to the paper discharge part.

15. The image forming apparatus of claim of 9, further comprising:

a tray in which stapled print media is loaded; and an ejector module which transmits the stapled print media to the tray.

* * * * *